United States Patent [19]

Duval et al.

[11] 4,143,668

[45] Mar. 13, 1979

[54] ROLLER-TYPE COSMETIC APPLICATOR

[75] Inventors: Ernest H. Duval, Winthrop; Harold R. Thompson, Duxbury, both of Mass.

[73] Assignee: The Gillette Company, Boston, Mass.

[21] Appl. No.: 797,001

[22] Filed: May 16, 1977

[51] Int. Cl.[2] ..... A45D 40/30

[52] U.S. Cl. ..... 132/88.5

[58] Field of Search ..... 132/88.5, 88.7, 112; 15/30, 36, 529, 131; 401/208, 220; 119/86

[56] References Cited

U.S. PATENT DOCUMENTS

| | | | |
|---|---|---|---|
| 2,187,585 | 1/1940 | Grigas | 401/208 X |
| 2,995,083 | 8/1961 | Wright | 401/208 X |
| 3,104,413 | 9/1963 | Nelson | 401/208 X |
| 3,702,739 | 11/1972 | Rentfrow | 401/220 X |
| 3,995,597 | 12/1976 | Warwick | 132/112 |

*Primary Examiner*—G.E. McNeill

*Attorney, Agent, or Firm*—Richard A. Wise; Mandel E. Slater

[57] ABSTRACT

A roller-type cosmetic applicator is described featuring a cap of T-configuration adapted to fit on the outlet of a product container. The head portion of the cap has an integral cylindrical bearing element through which extends an axle having two rollers affixed at opposite ends. The axle has a reduced central portion defining a chamber between the axle and the bearing element. The chamber is in communication with the container, and, through two small openings, with the uppermost portion of the cap, where the product is delivered for distribution by the rollers. In one embodiment the reduced portion of the axle is provided with vanes comprising an impeller, which when rotated with the rollers and axle, assist dispensing of the product.

6 Claims, 4 Drawing Figures

ROLLER-TYPE COSMETIC APPLICATOR

BACKGROUND OF THE INVENTION

1. Field of the Invention

This invention relates to cosmetic applicators, and is directed more particularly to applicators having an elongated roller to distribute a cosmetic product on the skin of the user.

2. Description of the Prior Art

Roller-type applicators for cosmetic products are well known in the art and have enjoyed wide commercial use, especially in the application to the skin of deodorants and antiperspirants. Convenient in use, they are also associated with high efficacy, due at least in part to their ability to deposit a concentrated dose of active material precisely where it will do the most good. Furthermore, environmental concern over the use of certain fluorocarbon propellants is causing renewed interest in non-aerosol means of dispensing and applying such products.

However certain types of product formulation lend themselves more readily to one kind of dispensing system than another. For example roller-type applicators function well and have been used with particular success for products having a uniform creamy or oily consistency, while pressurized aerosol dispensers have provided an effective way to spray products in the form of relatively unstable solid-liquid suspensions. Some of these suspension-type products, such as antiperspirants including certain aluminum or zirconium salts in a volatile silicone carrier, present special sealing problems in dispensing with an applicator comprising a roller in a socket. If the clearances are kept relatively close, as is customary, the ball is likely to stick or bind as the result of solids becoming trapped on the bearing surfaces. On the other hand if the clearances are opened up to accommodate such non-greasy suspension-type products, the sticking can be reduced, but leakage of the liquid carrier becomes a severe problem when, as often happens, the product is stored in any orientation other than upright.

It has also been found desirable in numerous applications to employ an elongated or oblong roller, in order to provide a wide contact area for applying deodorants, antiperspirants, and the like. However as can be appreciated, the problems of sticking and leakage described above for certain kinds of formulations become even more aggravated with a bigger roller.

Another difficulty with known roller-type cosmetic applicators having either a round or elongated ball turning in a socket is the tendency of the system to entrap and pull on body hair, a problem which affects a substantial portion of male users of roller-type deodorants and antiperspirants.

SUMMARY OF THE INVENTION

Accordingly it is an object of the invention to provide a roller-type cosmetic applicator which works well with solid-liquid suspension-type formulations, while avoiding product leakage or binding of the roller.

Another object of the invention is to provide an applicator of the type described in which the use of an elongated roller does not aggravate the aforementioned product leakage or binding roller problems.

A further object of the invention is the provision of a roller-type cosmetic applicator which does not tend to entrap and pull on the hair of the user.

With the above and other objects in view a feature of the present invention is the provision of a roller-type cosmetic applicator in which a pair of rollers is fixed at opposite ends of an axle journaled within a generally hollow cylindrical bearing element. The axle has a reduced central portion defining a chamber bounded by the remainder of the axle and the bearing element. Post structure connects the bearing element to a product container and has an internal duct providing communication between the chamber and the product container. At least one opening is formed in the bearing element in registration with the chamber and generally opposite the post, in order that product dispensed through the opening may readily be distributed by the rollers.

In one embodiment of the invention the post is narrow (along the roller axis) and in abutment with, and of the same diameter as, the rollers. With this arrangement the two rollers and the small fixed structure between are like a single large roller, connected to, but nevertheless standing away from the product container and free of any socket that can entrap the hair of the user. The rollers may also be provided with a surface of any desired texture or shape, since, according to the invention, they do not function as bearing elements for the system nor form a critical part of the sealing arrangement.

The product container (which forms no part of the invention) can be either a rigid container or a compressible container, the latter with or without a diptube. For reasons that will be shown presently, pressure is not required to feed product to the rollers, and a rigid container is preferred. In addition pressure applied to an excessive degree can cause flooding of the system or tend to force leakage through pathways that are otherwise leak-free.

In a preferred embodiment of the invention the chamber formed between the reduced central portion of the axle and the bearing element is partitioned by a plurality of vanes dividing the chamber into a plurality of separate compartments sealed off one from another, and in sufficient number and so dimensioned and arranged that communication between the duct supplying product from the container and the opening(s) in the bearing element for carrying the product to the outside, is interrupted by the vanes. With this arrangement when the rollers are not rotating, the vanes act as a closure or seal for the system, but when the rollers are turning, the vanes function as an impeller, aiding delivery of the product.

The above and other features of the invention, including various novel details of construction and combinations of parts, will now be more particularly described with reference to the accompanying drawing and pointed out in the claims. It will be understood that the particular devices embodying the invention are shown by illustration only and not as a limitation of the invention. The principles and features of this invention may be employed in various and numerous embodiments without departing from the scope of the invention.

BRIEF DESCRIPTION OF THE DRAWING

Referance is made to the accompanying drawing in which are shown illustrative embodiments of the invention from which its novel features and advantages will be apparent.

DESCRIPTION OF A PREFERRED EMBODIMENT

Figure 1:
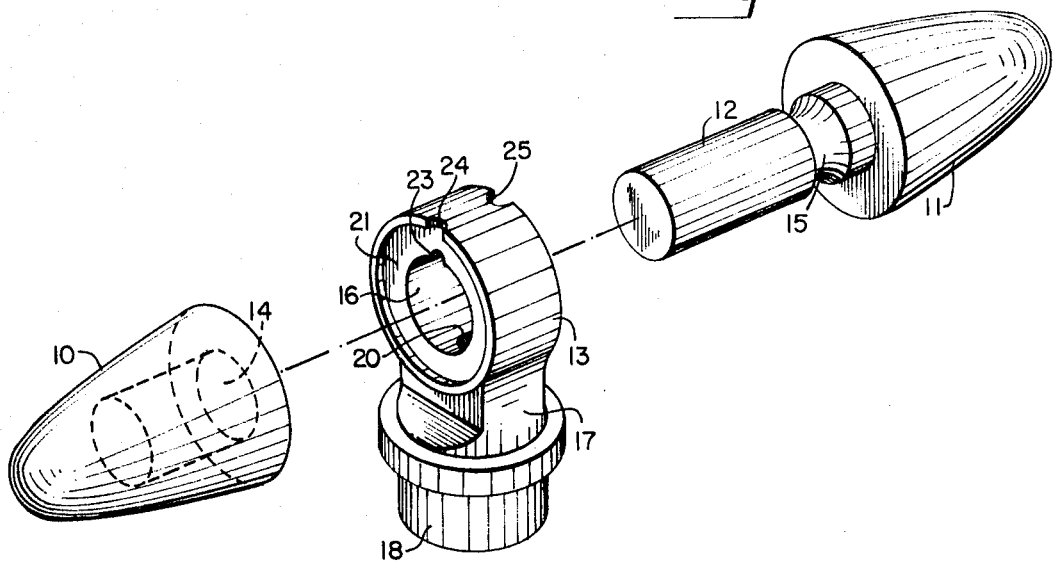
FIG. 1 is an exploded isometric view of one form of roller-type cosmetic applicator illustrative of the invention.
Figure 2:
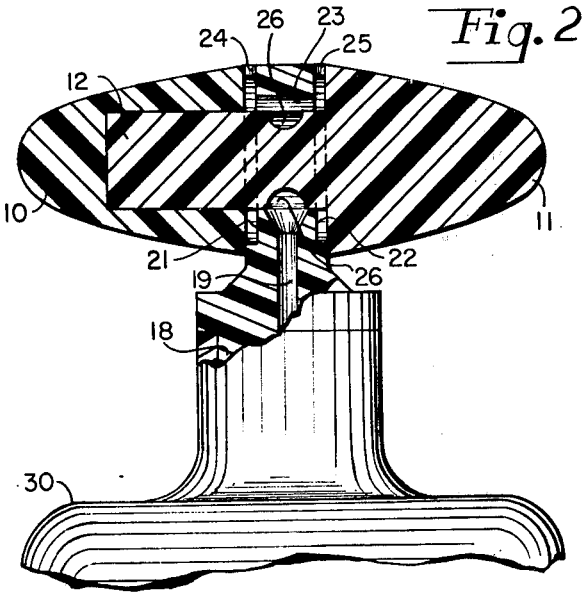
FIG. 2 is an elevational view, partially in section, of an assembly of the components of FIG. 1, shown connected to a product container.

Referring to the drawing and in particular to FIGS. 1 and 2, it will be seen that the illustrative roller-type cosmetic applicator includes a pair of smoothly-tapered rollers 10, 11, axle 12, bearing element 13, and a substantially rigid product container 30, of which only the upper portion is shown. Roller 11 and axle 12 are shown as a single piece, but it is to be appreciated that they may be formed separately and fit together during assembly. Roller 10 is provided with a central recess 14 complementary to the axle, in order to provide for press fitting these parts during assembly. The axle has a reduced diameter portion, shown at 15.

The bearing element 13 has an internal cylindrical bearing surface 16 complementary to axle 12 and dimensioned to permit free rotation thereof within the bearing element. A post 17 is formed as an integral part of the bearing element and includes a plug portion 18 at its lower end for connection to the product container 30. (It will be appreciated that alternative connecting means may be employed, a screw threaded arrangement being one example.) An internal duct 19 provides communication between the product container through the post to bearing surface 16, where the upper end of the duct is shown at 20. The bearing element has a stepped construction providing a pair of annular shoulders 21, 22 at either side of bearing surface 16; this construction reduces what will be the area of contact between the bearing element and the rollers, allowing easier rotation. A channel 23 is formed in the upper portion of bearing surface 16, extending in axial direction along its entire length. Two generally U-shaped cutouts 24, 25 extend through the top of the bearing element at opposite edges thereof adjacent annular shoulders 21, 22.

Assembly of the device involves merely inserting a subassembly of the axle and one roller through the bearing element and press fitting the other roller on the free end of the axle. The reduced diameter portion 15 of the axle has been formed so that upon assembly it is centrally located within the bearing element where it defines a ring-shaped chamber 26 bounded by the axle and bearing surface 16. The rollers fit the axle so that on assembly they are in abutment with the bearing element and provide end walls to the U-shaped cutouts 24, 25, which become the exit orifices for the product to be dispensed.

In operation the applicator is up-ended sufficiently to bring the product to duct 19, and the rollers are rubbed along the skin surface, causing the rollers to turn. The product flows through duct 19, into ring-shaped chamber 26, along channel 23, across shoulders 21, 22, and out exit orifices 24, 25, from where it is distributed on the skin with the aid of the rollers. With typical formulations, even those having a low surface tension, it has been found that the product does not run out by gravity alone; but the operation of the rollers interferes with surface tension effects in such a way as to provide effective metering of product flow.

It is to be appreciated that the provision of a symmetrical reduced diameter portion of the axle as shown at 15 of FIG. 1 results in the formation of a continuous ring-shaped chamber defined by the portion 15 and bearing surface 16. If at 15 the axle were instead provided with one or more depressions in its surface, these depressions would make the chamber discontinuous by dividing it into one or more separate chambers rotating with the axle and functioning as an impeller arrangement, further to assist dispensing of the product. Such an arrangement is shown in the embodiment of FIGS. 3 and 4, in which the "depressions" at the central portion of the axle are actually separate chambers defined by a plurality of vanes extending between the central portion of the axle and the bearing surface.

Figure 3:
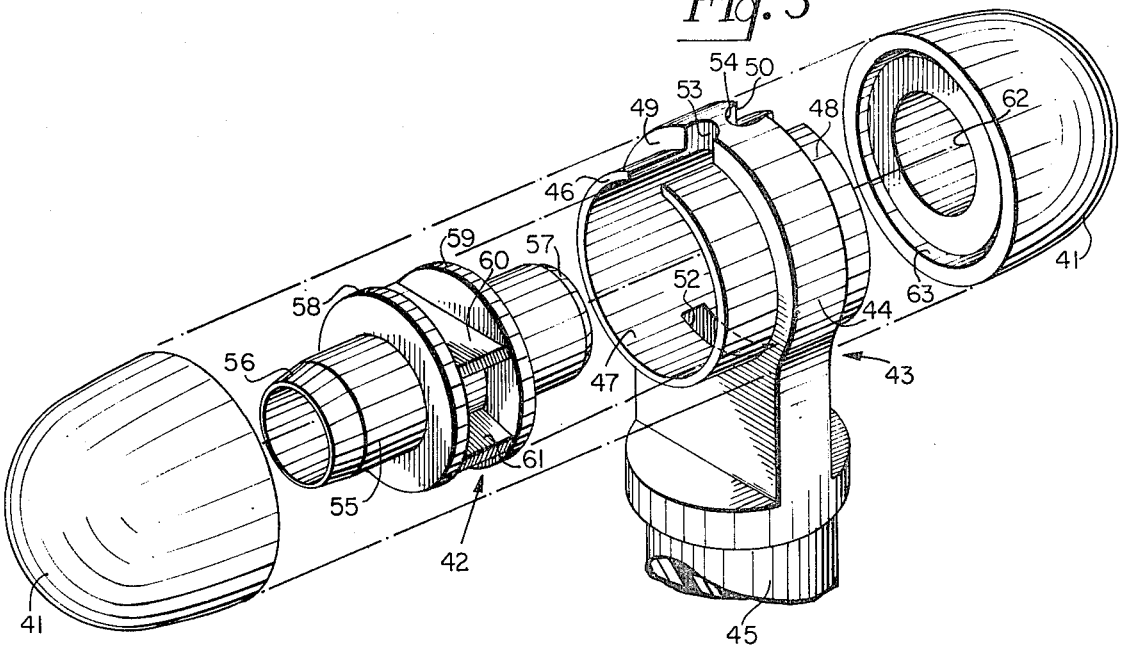
FIG. 3 is an exploded isometric view, similar to FIG. 1, illustrative of a further embodiment of the invention.
Figure 4:
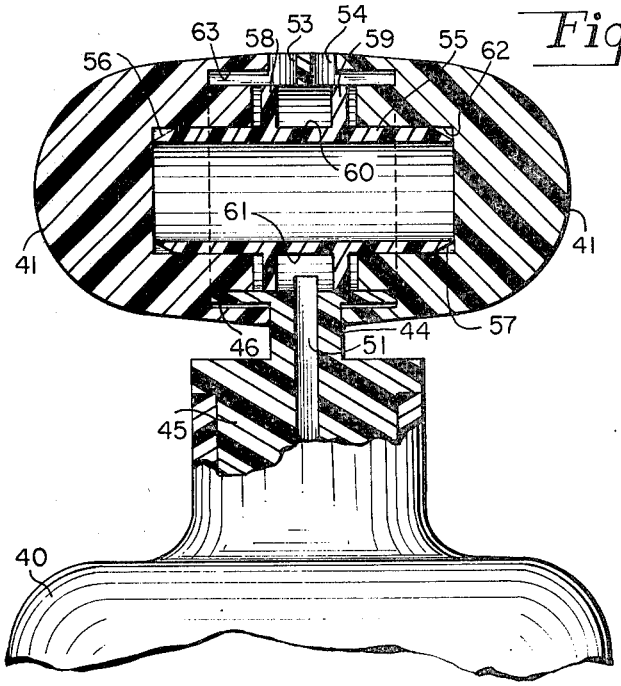
FIG. 4 is an elevational view, partially in section, and similar to FIG. 2, showing an assembly of the components of FIG. 3.

Referring now to FIGS. 3 and 4, the roller-type cosmetic applicator shown therein includes a pair of identical smoothly-rounded rollers 41, axle 42, bearing element 43, and a substantially rigid product container 40, of which only the upper portion is shown. The bearing element includes a central post portion 44 terminating at its lower end in a plug 45 for connection to the product container. An integral cylindrical sleeve 46 extends laterally through the upper part of the post, defining internal and external bearing surfaces 47, 48 and shoulders 49, 50 where the sleeve intersects the post. An internal duct 51 extends vertically through the post from the bottom of the plug to the internal bearing surface 47, where the upper end of the duct is shown at 52 (FIG. 3). Two U-shaped cutouts 53, 54 in the top of the bearing element extend through the top of post 44, and interrupt shoulders 49, 50 and sleeve 46, extending to the inside thereof.

Axle 42 is received within sleeve 46 of bearing element 43 and includes a hollow central tube 55 terminating at opposite ends in a pair of stub shafts 56, 57. A pair of integral washers 58, 59 centrally spaced on the tube and normal to its axis extend to internal bearing surfaces 47 and are dimensioned for smooth rotation of the axle within sleeve 46. A pair of parallel vanes 60, 61 (as best seen in FIG. 3) between washers 58, 59 and tangent to tube 55 provide four separate chambers bounded by tube 55, washers 58, 59, bearing surface 47, and the vanes 60, 61. Rollers 41 each have a central cylindrical recess 62 to receive stub shafts 56, 57, and also an annular recess 63 to receive the laterally-extending portions of sleeve 46. The rollers fit snugly on the stub shafts, but just loosely enough on the sleeve for free rotation with respect thereto.

Assembly of the apparatus is substantially as before, with axle 42 inserted into bearing element 43 and the rollers 41 press fit on the projecting stub shafts 56, 57 of the axle. The parts are so dimensioned that in the completed assembly the rollers abut shoulders 49, 50 and provide end walls for the U-shaped cutouts 53, 54, which become the exit orifices for the product, in registration with the chamber area defined by tube 55, bearing surface 47, and washers 58, 59.

The operation is also substantially the same as described above for the embodiment of FIGS. 1 and 2, except that when the product flows through duct 51 to the aforementioned chambers, the vanes 60, 61 act as an impeller, assisting delivery of product through the exit orifices 53, 54 by centrifugal force. This operation provides effective metering of product flow, which increases as the rollers are caused to turn more rapidly.

It will be appreciated that in the embodiment of FIGS. 3 and 4, communication between the product container and the outside is interrupted by the impeller arrangement, and product can flow only when the impeller is turning. This aspect of the invention provides certain additional advantages. First, in the absence of any other sealing arrangement, it is possible to shake the container vigorously to mix the product without any of it escaping. Second, the rollers and bearing element structure can be rinsed without risk of diluting the product, since material on the surface can not get inside the container unless the rollers are turning. This reduces the risk of bacterial contamination of the product, making this arrangement more hygienic.

The extended sleeve 46 utilized in the embodiment of FIGS. 3 and 4 also provides certain advantages. First it makes leakage from locations other than the exit orifices less likely, by forcing any such leakage to follow a more circuitous path. Second, the extended bearing surfaces allow smoother rolling when force is applied off the center of the roller arrangement.

It should also be appreciated that additional sealing means may be provided for the applicator. For example a protective or decorative cap can include resilient sealing means to close off the exit orifices when the cap is in place. A useful alternative to an external seal for the exit orifices is the provision, by known means, of an on-off closure at the mouth of the product container associated with the connection of the bearing element to the container.

While various aspects of the invention have been illustrated by the foregoing detailed embodiments, it will be understood that various substitutions of equivalents may be made without departing from the spirit and scope of the invention.

What is claimed is:

1. A roller-type cosmetic applicator comprising a pair of rollers fixed at opposite ends of an axle journaled within a generally hollow cylindrical bearing element, said axle defining a chamber between said axle and said bearing element, and structure connecting said bearing element to a product container and having an internal duct providing communication to said chamber from said product container, said bearing element having at least one opening removed from said connecting structure and in registration with said chamber, for dispensing said cosmetic for distribution by said rollers.

2. An applicator as defined in claim 1, in which said axle has a reduced central portion defining said chamber.

3. An applicator as defined in claim 1, in which said chamber is in the form of a continuous ring around said axle.

4. An applicator as defined in claim 1, in which said chamber is discontinuous around said axle.

5. An applicator as defined in claim 4, in which said chamber is partitioned by a plurality of vanes extending between said axle and said bearing element.

6. An applicator as defined in claim 1, in which said rollers and said bearing element are arranged in T-configuration upstanding from said product container.

* * * * *